US010072533B2

(12) United States Patent
Hauvespre et al.

(10) Patent No.: US 10,072,533 B2
(45) Date of Patent: Sep. 11, 2018

(54) CAM FOLLOWER ROLLER DEVICE

(71) Applicants: Benoît Hauvespre, Saint Etienne de Chigny (FR); Nicolas Berruet, Artannes sur Indre (FR); Charles Chambonneau, Joué lès Tours (FR); Mickael Chollet, Joué-lès-Tours (FR); Gwenael Hingouet, Saint-cyr-sur-Loire (FR); Samuel Viault, Saint-Antoine-du-Rocher (FR)

(72) Inventors: Benoît Hauvespre, Saint Etienne de Chigny (FR); Nicolas Berruet, Artannes sur Indre (FR); Charles Chambonneau, Joué lès Tours (FR); Mickael Chollet, Joué-lès-Tours (FR); Gwenael Hingouet, Saint-cyr-sur-Loire (FR); Samuel Viault, Saint-Antoine-du-Rocher (FR)

(73) Assignee: AKTIEBOLAGET SKF, Gothenburg (SE)

( * ) Notice: Subject to any disclaimer, the term of this patent is extended or adjusted under 35 U.S.C. 154(b) by 29 days.

(21) Appl. No.: 15/350,434

(22) Filed: Nov. 14, 2016

(65) Prior Publication Data

US 2017/0175591 A1 Jun. 22, 2017

(30) Foreign Application Priority Data

Dec. 17, 2015 (EP) ..... 15307043

(51) Int. Cl.

| | |
|---|---|
| ***F01L 1/14*** | (2006.01) |
| ***F02M 59/10*** | (2006.01) |
| ***F02M 59/44*** | (2006.01) |
| ***F04B 1/04*** | (2006.01) |

(52) U.S. Cl.

CPC ..... *F01L 1/14* (2013.01); *F02M 59/102* (2013.01); *F02M 59/44* (2013.01); *F04B 1/04* (2013.01); *F04B 1/0413* (2013.01); *F04B 1/0426* (2013.01); *F04B 1/0435* (2013.01); *F01L 2101/00* (2013.01); *F01L 2105/02* (2013.01)

(58) Field of Classification Search

CPC ..... F02M 59/102; F02M 59/44; F01L 1/14; F01L 2101/00; F01L 2105/02; F04B 1/04

See application file for complete search history.

(56) References Cited

U.S. PATENT DOCUMENTS

| | | | | |
|---|---|---|---|---|
| 1,802,330 A | | 4/1931 | Boland | |
| 3,108,580 A | * | 10/1963 | Crane, Jr. | F01L 1/14 123/90.5 |
| 5,931,133 A | | 8/1999 | Giannone et al. | |

(Continued)

FOREIGN PATENT DOCUMENTS

| | | |
|---|---|---|
| DE | 102011084850 A1 | 4/2013 |
| EP | 1645728 A2 | 4/2006 |

(Continued)

*Primary Examiner* — Zelalem Eshete

(74) *Attorney, Agent, or Firm* — Bryan Peckjian; SKF USA Inc. Patent Dept.

(57) ABSTRACT

The cam follower roller device provides a tappet body, a pin and a roller mounted on the pin. The tappet body provides holes for mounting pin ends of the pin on the tappet body. The device further provides one deformable ring disposed between each pin end of the pin and an inner wall of the associated hole of the tappet body.

14 Claims, 1 Drawing Sheet

(56) References Cited

U.S. PATENT DOCUMENTS

| | | | |
|---|---|---|---|
| 2010/0012065 | A1 | 1/2010 | Dorn et al. |
| 2015/0285104 | A1 | 10/2015 | Sailer et al. |

FOREIGN PATENT DOCUMENTS

| | | | |
|---|---|---|---|
| EP | 2607636 | A1 | 6/2013 |
| EP | 2937566 | A1 | 10/2015 |
| EP | 2955342 | A1 | 12/2015 |

* cited by examiner

CAM FOLLOWER ROLLER DEVICE

CROSS REFERENCE TO RELATED APPLICATIONS

This application claims priority to European patent application no. 15307043.8 filed on Dec. 17, 2015, the contents of which are fully incorporated herein by reference.

FIELD OF THE INVENTION

The present invention relates to the field of cam follower roller devices used in automotive or industrial applications.

One advantageous application of the invention is the use of the cam follower roller device in a fuel injection pump intended for an internal combustion engine, in particular of a motor vehicle. Another advantageous application of the invention is the use of the device in a rocker system intended for controlling valves of an internal combustion piston engine.

BACKGROUND OF THE INVENTION

Such a cam follower roller device generally provides an outer tappet body, a pin mounted on the tappet body and a roller movable in rotation relative to the pin around its axis. When the cam follower roller device is in service in a fuel injection pump, the roller collaborates with a cam synchronized with the internal combustion engine camshaft or crankshaft. The rotation of the camshaft, or crankshaft, leads to a periodic displacement of a piston of the pump that rests against the tappet body, to allow fuel to be delivered.

In operation, the device is intended to slide back and forth into a housing, such as a pump housing. Generally, there is an angular misalignment between the axis of the tappet body and the axis of the associated housing. Accordingly, edge stresses may occur at the ends of the roller of the device with the contact against the cam. Accordingly, in operation, the pressure contact between the roller and the cam may be increased.

One aim of the present invention is to overcome these drawbacks.

BRIEF SUMMARY OF THE INVENTION

It is a particular object of the present invention to provide a cam follower roller device having a design adapted to reduce edge stresses on the roller in operation.

In one embodiment, the cam follower roller device provides a tappet body, a pin and a roller mounted on the pin, the tappet body comprising holes for mounting pin ends of the pin on the tappet body. The device further provides one deformable ring disposed between each pin end of the pin and an inner wall of the associated hole of the tappet body.

With such a disposition of each deformable ring, a flexible connection is provided between the pin supporting the roller and the tappet body rather than a rigid connection. With regard to an axis of the pin, each deformable ring is radially disposed between each pin end and the inner wall of the associated hole of the tappet body.

Accordingly, the axis of the pin may tilt relative to a rear abutment surface of the tappet body against which a movable element is intended to bear. When the device is in service in a fuel injection pump, the piston of the pump rests against the rear abutment surface.

The pin supporting the roller is able to move angularly relative to the tappet body to accommodate angular misalignment between the axis of the tappet body and the axis of a housing into which is mounted the device, such as a pump housing. When such a tilting occurs, the rings are deformed. The edge stresses that may occur at the ends of the roller with the contact against the associated cam is reduced. Accordingly, in operation, the pressure contact between the roller and the cam may be reduced.

Preferably, each deformable ring is secured to the tappet body.

Advantageously, an outer surface of each deformable ring is in radial contact with the inner wall of the associated hole of the tappet body.

In one embodiment, a bore of each deformable ring is in radial contact with the associated pin end of the pin. Accordingly, each deformable ring is radially interposed between the associated pin end and the inner wall of the associated hole of the tappet body.

In another embodiment, the device further provides one sleeve interposed between each pin end of the pin and the associated deformable ring. With regard to the axis of the pin, the sleeve is radially interposed between each pin end and the associated deformable ring. Each pin end may be press-fitted into the associated sleeve.

Each sleeve may provide at least one tubular portion interposed between each pin end and the associated deformable ring. In one embodiment, each sleeve provides only the tubular portion. Alternatively, each sleeve may further provide a radial flange connected to the tubular portion and extending radially outwards, the radial flange being axially located on the side opposite to the roller with respect to the tappet body. The radial flange may extend one end of the tubular portion. The radial flange may also come into contact with the associated deformable ring and/or the tappet body. Each sleeve may be made advantageously from rigid material, such as metal.

In one embodiment, each deformable ring is made from deformable material, preferably elastically deformable material. The deformable ring may be made from synthetic material such as plastic material or elastomer or nitrile rubber or polyurethane. The tappet body may be made advantageously from rigid material, such as metal.

BRIEF DESCRIPTION OF THE SEVERAL VIEWS OF THE DRAWING

The present invention and its advantages will be better understood by studying the detailed description of specific embodiments given by way of non-limiting examples and illustrated by the appended drawings on which.

DETAILED DESCRIPTION OF THE INVENTION

Figure 1:
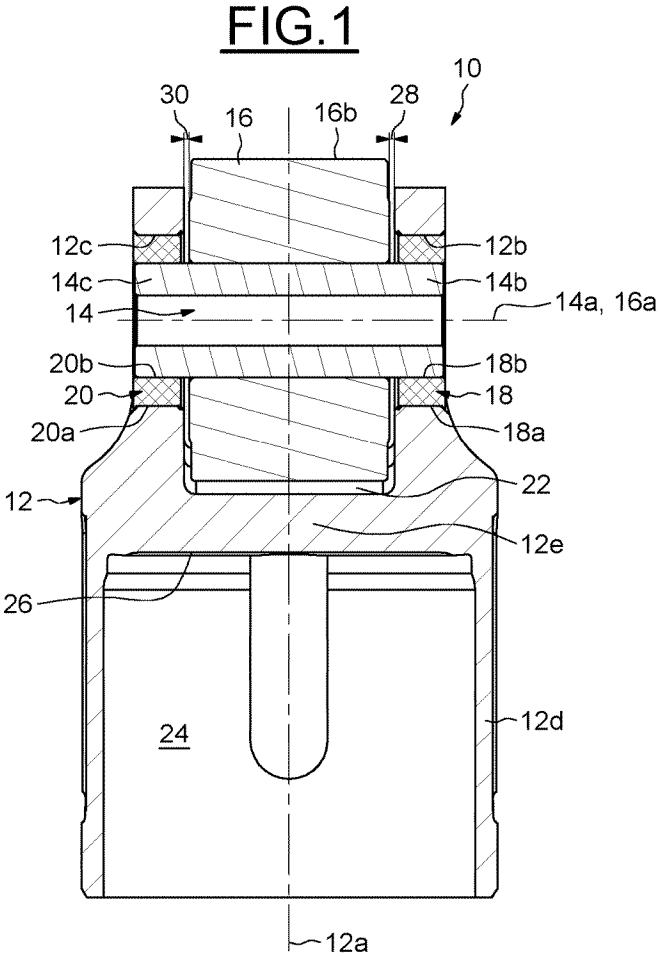
FIG. 1 is a cross-section of a cam follower roller device according to a first example of the invention.

As shown on FIG. 1, a cam follower roller device 10 provides a tappet housing or body 12 extending along an axis 12*a*, a shaft or pin 14 extending along an axis 14*a* perpendicular to the axis 12*a*, and a roller 16, with an axis 16*a* coaxial with the axis 14*a*, mounted on the pin and movable in rotation relative to the pin. In the disclosed embodiment, the roller 16 is directly mounted on the pin 14. Alternatively, a rolling bearing or a plain bearing may be radially interposed. The roller 16 provides an axial cylindrical outer surface (not referenced) which forms a contact surface intended to bear against the associated cam of the internal combustion engine, and two opposite radial frontal end faces (not referenced) axially delimiting the outer surface.

The pin 14 is mounted on the tappet body 12. The tappet body 12 supports the pin 14. The pin 14 provides two opposite pin ends 14*b*, 14*c* and a central portion (not referenced) extending between the pin ends. The central portion of the pin delimits a cylindrical outer bearing seat for the roller 16. The portion of the pin 14 left free by the tappet body 12 delimits the central portion. The pin ends 14*b*, 14*c* extend axially on either side of the roller 16. The tappet body 12 provides through-holes 12*b*, 12*c* for mounting the pin ends 14*b*, 14*c*. The through-holes face one another.

As will be described later, the device 10 further provides two annular deformable rings 18, 20 each radially interposed between one of the pin ends 14*b*, 14*c* and an inner wall of the associated through-hole 12*b*, 12*c* of the tappet body.

In the disclosed example, the tappet body 12 is made in one part. The tappet body 12 delimits a first open cavity 22 inside which is located the roller 16. The roller 16 is mounted inside the cavity 22. The roller 16 axially protrudes outwards with respect to an upper face (not referenced) of the tappet body. The tappet body 12 also delimits a second open cavity 24 oriented axially on the side opposite to the cavity 22. A movable element (not shown), such as a piston of a fuel injection pump, is intended to extend into the cavity 24 and to axially bear against a rear abutment surface 26 of the tappet body. The rear abutment surface 26 is oriented axially on the side opposite to the roller 16. The rear abutment surface 26 is planar and extends radially.

The tappet body 12 provides an outer axial sleeve portion 12*d* and an inner radial portion 12*e* extending radially an inner bore of the sleeve portion. The radial portion 12*e* delimits the rear abutment surface 26. The sleeve portion 12*d* has a tubular form. The through-holes 12*b*, 12*c* are formed on the axial sleeve portion 12*d*. The through-holes 12*b*, 12*c* are made into the thickness of the sleeve portion 12*d* and open into the cavity 22. Each through-hole 12*b*, 12*c* is delimited in the radial direction by its inner wall or bore. The cavity 22 is delimited axially by the radial portion 12*e*. The cavity 22 is delimited radially by the bore of the sleeve portion 12*d*. Similarly to the cavity 22, the cavity 24 is delimited axially by the radial portion 12*d* and radially by the bore of the sleeve portion 12*e*. The cavities 22, 24 are disposed on either side of the radial portion 12*e*.

Each pin end 14*b*, 14*c* is mounted into the deformable ring 18, 20 itself inserted into the associated through-hole 12*b*, 12*c* of the tappet body. Each deformable ring 18, 20 is radially located between the pin end 14*b*, 14*c* and the inner wall of the associated through-hole 12*b*, 12*c*. In the illustrated example, each deformable ring 18, 20 is in radial contact with the pin end 14*b*, 14*c* on one side and in radial contact with the tappet body 12 on the other side. Each deformable ring 18, 20 comes radially into contact with the inner wall of the associated through-hole 12*b*, 12*c*. Each deformable ring 18, 20 comes radially into contact with the outer surface of the associated pin end 14*b*, 14*c*. Accordingly, as previously mentioned, each deformable ring 18, 20 is radially interposed between one of the pin ends 14*b*, 14*c* and the tappet body 12.

Each deformable ring 18, 20 provides an axial cylindrical outer surface 18*a*, 20*a* in radial contact with the bore of the associated through-hole 12*b*, 12*c*, and a cylindrical bore 18*b*, 20*b* radially opposed to the outer surface and in radial contact with the outer surface of the associated pin end 14*b*, 14*c*.

Each deformable ring 18, 20 also provides two opposite inner and outer lateral surfaces (not referenced) which axially delimit the outer surface 18*a*, 20*a* and the bore 18*b*, 20*b*. In the illustrated example, the inner lateral surface of each ring 18, 20 is axially offset outwards with respect to an inner wall of the tappet body. Alternatively, the inner lateral surface may be coplanar with the inner wall or may axially slightly protrude towards the roller 16. An axial gap 28, 30 is provided between each frontal surface of the roller and the tappet body 12.

Each deformable ring 18, 20 is secured to the tappet body 12. Each deformable ring 18, 20 is secured into the associated through-hole 12*b*, 12*c*, by any appropriate means, for example by gluing or overmoulding. Each deformable ring 18, 20 is made from deformable flexible material, for example elastically deformable material. Each deformable ring 18, 20 may be made from synthetic material such as plastic material or elastomer or nitrile rubber or polyurethane.

With the disposition of the deformable rings 18, 20 between the pin ends 14*b*, 14*c* of the pin and the through-holes 12*b*, 12*c* of the tappet body 12, a flexible connection is provided between the pin and the tappet body. Accordingly, an angular tilting of the pin 14 supporting the roller 16 with respect to the tappet body 12 may be obtained. The axis 14*a* of the pin may tilt angularly relative to the abutment surface 26 of the tappet body. Such a tilting may be obtained since the axial gaps 28, 30 are provided between the roller 16 and the tappet body 12. The deformable rings 18, 20 are locally compressed in this case.

When the device 10 is mounted into the associated housing, such as a pump housing, the pin 14 is able to move angularly relative to the tappet body 12 to accommodate angular misalignment between the axis of the housing and the axis 12*a* of the tappet body. With a contact between the roller 16 of the device and the cam of the internal combustion engine, the roller supported by the pin 14 may tilt angularly relative to the tappet housing 12. This has the effect of reducing the edge stresses that may occur at the ends of the roller 16. Accordingly, in operation, the pressure contact between the roller 16 and the cam may be reduced.

Figure 2:
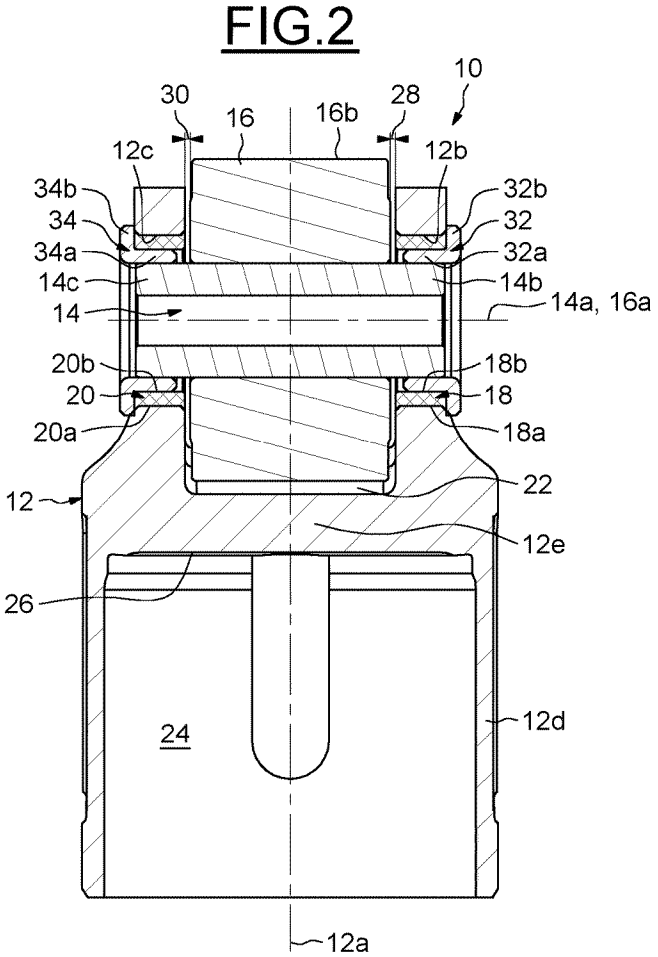
FIG. 2 is a cross-section of a cam follower roller device according to a second example of the invention.

The example illustrated on FIG. 2, in which identical parts are given identical references, differs from the previous example in that the device 10 further provides a sleeve 32, 34 radially interposed between each deformable ring 18, 20 and the associated pin end 14*b*, 14*c* of the pin. Here, contrary to the first example, each deformable ring 18, 20 secured to the tappet body is not in direct contact with the associated pin end 14*b*, 14*c*.

Each deformable ring 18, 20 is in radial contact with the associated sleeve 32, 34 on one side and in radial contact with the tappet body 12 on the other side. Each deformable ring 18, 20 comes radially into contact with the outer surface of the associated sleeve 32, 34. The bore 18*a*, 20*a* of each deformable ring is mounted in radial contact with the associated sleeve 32, 34. Each pin end 14*b*, 14*c* of the pin is inserted into an axial bore or hole delimited by the associated sleeve 32, 34. Each pin end 14*b*, 14*c* is fixed into the hole of the associated sleeve 32, 34 for example by push-fitting. Preferably, each sleeve 32, 34 is made from metal. Alternatively, each sleeve may be made from other rigid material, for example from a synthetic material such as PA.

Each sleeve 32, 34 provides an axial tubular portion 32*a*, 34*a* delimiting the outer surface in contact with the associated deformable ring 18, 20 and the hole into which is inserted the associated pin end 14*b*, 14*c*. The tubular portion is radially interposed between each pin end 14*b*, 14*c* and the associated deformable ring 18, 20.

Each sleeve 32, 34 further provides a radial flange 32*b*, 34*b* extending radially outwards from one end of the tubular portion 32*a*, 34*a*. Each flange 32*b*, 34*b* is axially located on the side opposite to the roller 16 with respect to the tappet body 12. In the illustrated example, each flange 32*b*, 34*b* comes axially into contact with the outer lateral surface of the associated deformable ring 18, 20 and with the tappet body 12. Alternatively, a slight axial gap may be provided therebetween. The flange 32*b*, 34*b* of each sleeve prevents an axial flow or creep of the associated deformable ring 18, 20 when a tilting of the pin 14 occurs. However, in another embodiment, it could be possible to design the sleeves 32, 34 without the flanges.

In the illustrated examples, each deformable ring of the device is made from an elastically deformable material. Alternatively, each deformable ring may be made from a plastically deformable material.

The invention claimed is:

1. A cam follower roller device comprising:

a tappet body, a pin having two pin ends, an outer pin surface located between the two pin ends and having a cylindrical shape, the pin having an initial central axis, a roller mounted on the pin, the tappet body having holes for mounting the two pin ends of the pin on the tappet body, and each of the two pin ends having one deformable ring disposed between the outer pin surface adjacent the associated pin end and an inner wall of the associated hole of the tappet body such that the one deformable ring only radially contacts the outer pin surface and such that the pin may tilt angularly relative to the intial central axis.

2. The device according to claim 1, wherein each deformable ring is secured to the tappet body.

3. The device according to claim 1, wherein an outer surface of each deformable ring is in radial contact with the inner wall of the associated hole of the tappet body.

4. The device according to claim 1, wherein a bore of each deformable ring is in radial contact with the associated pin end of the pin.

5. The device according to claim 1, wherein each deformable ring is made from deformable material.

6. The device according to claim 5, wherein each deformable ring is made from elastically deformable material.

7. The device according to claim 1, wherein the tappet body is made in one part.

8. A cam follower roller device comprising:

a tappet body, a pin, a roller mounted on the pin, the tappet body having holes for mounting pin ends of the pin on the tappet body, one deformable ring disposed between each pin end of the pin and an inner wall of the associated hole of the tappet body, and one sleeve interposed between each pin end of the pin and the associated deformable ring.

9. The device according to claim 8, wherein each pin end of the pin is press-fitted into the associated sleeve.

10. The device according to claim 8, wherein each sleeve comprises at least one tubular portion interposed between each pin end of the pin and the associated deformable ring.

11. The device according to claim 10, wherein each sleeve further comprises a radial flange connected to the tubular portion and extending radially outwards, the radial flange being axially located on the side opposite to the roller with respect to the tappet body.

12. The device according to claim 11, wherein the radial flange of each sleeve extends one end of the tubular portion.

13. The device according to claim 11, wherein the radial flange of each sleeve axially comes into contact with at least one of the associated deformable ring and the tappet body.

14. The device according to claim 8, wherein each sleeve is made from metal.

* * * * *